US008899442B2

(12) United States Patent
Muramoto et al.

(10) Patent No.: US 8,899,442 B2
(45) Date of Patent: Dec. 2, 2014

(54) SYNTHETIC RESIN SPOUT STOPPER

(75) Inventors: Katsuhiro Muramoto, Kanagawa (JP); Masaki Nagase, Kanagawa (JP); Naoyuki Anbe, Kanagawa (JP); Katsumi Hashimoto, Kanagawa (JP)

(73) Assignee: Japan Crown Cork Co., Ltd., Tokyo (JP)

( * ) Notice: Subject to any disclaimer, the term of this patent is extended or adjusted under 35 U.S.C. 154(b) by 7 days.

(21) Appl. No.: 13/511,150

(22) PCT Filed: Dec. 17, 2010

(86) PCT No.: PCT/JP2010/072786

§ 371 (c)(1),
(2), (4) Date: May 22, 2012

(87) PCT Pub. No.: WO2011/078085

PCT Pub. Date: Jun. 30, 2011

(65) Prior Publication Data

US 2012/0234848 A1 Sep. 20, 2012

(30) Foreign Application Priority Data

Dec. 22, 2009 (JP) ..... 2009-291010

(51) Int. Cl.

*B65D 30/00* (2006.01)
*B65D 5/74* (2006.01)
*B65D 47/36* (2006.01)

(52) U.S. Cl.

CPC ..... *B65D 5/746* (2013.01); *B65D 47/36* (2013.01)
USPC ..... 220/789; 220/787; 220/786; 220/784; 215/296

(58) Field of Classification Search

CPC ..... B65D 5/746; B65D 2543/00296; B65D 2543/00092; B65D 2543/00694; B65D 2543/00796; B65D 2543/00731; B65D 2543/0062; B65D 39/00; B65D 47/36; B29C 65/00; B29C 65/08; B29C 66/53247; B65B 51/225; B29L 2031/7166; B67B 7/26
USPC ..... 222/541.9; 220/789, 787, 786, 784, 220/258.1, 258.2, 258.3, 270; 215/296, 215/295, 364, 356, 355, 253, 255, 256
See application file for complete search history.

(56) References Cited

U.S. PATENT DOCUMENTS 3,954,075 A * 5/1976 Jordan ..... 83/880
4,434,907 A * 3/1984 Ingemann ..... 220/276

(Continued)

FOREIGN PATENT DOCUMENTS

JP 10-16950 1/1998
JP 2001-240107 9/2001
JP 2009-228175 10/2009

OTHER PUBLICATIONS

Search report from International Patent Application No. PCT/JP2010/072786, mail date is Mar. 1, 2011.

*Primary Examiner* — Andrew Perreault
*Assistant Examiner* — James M Van Buskirk
(74) *Attorney, Agent, or Firm* — Greenblum & Bernstein, P.L.C.

(57) ABSTRACT

An improved synthetic resin spout stopper to be combined with a discharge port of a container is provided. The spout stopper does not pose difficulty in breaking an annular score formed in an annular flange wall, when discarding the container. Damage to the annular score is avoided even if a considerably great impact is applied to the spout stopper owing to a fall of the container. Damage to the annular score is also avoided even when ultrasonic welding is adopted for welding the container and the spout stopper together. In an inner peripheral edge part of the annular flange wall, an annular additional score is disposed adjacent to the annular score radially outwardly of and/or radially inwardly of the annular score.

18 Claims, 5 Drawing Sheets

(56) References Cited

U.S. PATENT DOCUMENTS

| | | | | | |
|---|---|---|---|---|---|
| RE31,759 | E | * | 12/1984 | Ingemann | 220/276 |
| 4,913,307 | A | * | 4/1990 | Takata et al. | 220/276 |
| 5,110,040 | A | * | 5/1992 | Kalberer et al. | 229/125.14 |
| 5,215,207 | A | * | 6/1993 | Stolzman | 220/359.4 |
| 5,244,520 | A | * | 9/1993 | Gordon et al. | 156/73.1 |
| 5,735,426 | A | * | 4/1998 | Babcock et al. | 220/258.2 |
| 5,797,510 | A | * | 8/1998 | Carrier et al. | 220/266 |
| 2001/0054616 | A1 | * | 12/2001 | Ramsey et al. | 220/258 |
| 2006/0060578 | A1 | * | 3/2006 | Church et al. | 220/4.21 |
| 2007/0083009 | A1 | * | 4/2007 | Chai | 525/240 |
| 2011/0114593 | A1 | | 5/2011 | Ishii et al. | |

* cited by examiner

SYNTHETIC RESIN SPOUT STOPPER

TECHNICAL FIELD

This invention relates to a synthetic resin spout stopper to be applied to a paper container having at least a synthetic resin film laminated to the inner surface or outer surface thereof. More specifically, the invention relates to a synthetic resin spout stopper comprising a protruding tubular wall allowed to protrude through or in succession to a spout hole formed in the container, and an annular flange wall extending out radially outwardly from the outer periphery of a lower end part of the protruding tubular wall, the stopper being of a form in which the upper surface or lower surface of the annular flange wall is welded to the inner surface or outer surface of the container, and an annular score is formed in an inner peripheral edge part of the annular flange wall.

BACKGROUND ART

Patent Document 1 indicated below discloses a polyethylene spout stopper to be applied to a paper container having at least a synthetic resin film laminated to the inner surface thereof. Such a spout stopper comprises a protruding tubular wall allowed to protrude through a spout hole formed in the container, and an annular flange wall extending out radially outwardly from the outer periphery of a lower end part of the protruding tubular wall. The upper surface of an outer peripheral edge part of the annular flange wall is welded to the inner surface of the container by an ultrasonic welding method. An annular score is formed in an inner peripheral edge part of the annular flange wall. For the purpose of so-called sorted trash collection for recovery, such an annular score is broken when the container is to be discarded after the contents of the container are consumed, so that most of the spout stopper is separated from the container. In an intermediate part in the radial direction of the annular flange, a corrugated portion or stepped portion is further formed for preventing the occurrence of a defect, such as a pinhole, in the annular score by an ultrasonic impact during the execution of welding by the ultrasonic welding method.

PRIOR ART DOCUMENTS

Patent Literature

Patent Document 1: JP-A-10-16950

SUMMARY OF THE INVENTION

Problems to be Solved by the Invention

The above-described spout stopper disclosed in Patent Document 1, however, poses the following problems to be solved: According to analysis by the present inventors, it is not infrequent that the container is fallen from a required site, whereby the spout stopper undergoes an impact, in the process of distribution of the containers. If the impact is caused to the spout stopper, the annular score formed in the annular flange wall of the spout stopper may be subjected to damage, such as partial breakage. To avoid the damage to the annular score, it is attempted to increase the residual wall thickness at the site of the annular score. So doing, however, makes it markedly difficult to break the annular score when discarding the container. Furthermore, the corrugated portion or stepped portion is formed in the annular flange wall in an attempt to absorb the impact during ultrasonic welding. However, its ultrasonic impact absorbing effect is not necessarily sufficient and, if the ultrasonic welding method is employed for welding, the annular score formed in the annular flange wall may be damaged.

The present invention has been accomplished in the light of the above-mentioned facts. Its principal technical challenge is to provide a novel and improved synthetic resin spout stopper which does not pose difficulty in breaking the annular score when discarding the container; which avoids damage to the annular score formed in the annular flange wall even if a considerably great impact is applied to the spout stopper owing to a fall of the container; and which also avoids damage to the annular score formed in the annular flange wall even when ultrasonic welding is adopted for welding the container and the spout stopper together.

Means for Solving the Problems

The present inventors conducted in-depth studies and experiments, and have found that the above principal technical challenge can be solved by disposing an annular additional score in the inner peripheral edge part of the annular flange wall, adjacent to the annular score radially outwardly of and/or radially inwardly of the annular score.

That is, according to the present invention, there is provided, as a spout stopper solving the above-mentioned principal technical challenge, a synthetic resin spout stopper to be applied to a paper container having at least a synthetic resin film laminated to an inner surface or outer surface thereof, comprising:

a protruding tubular wall allowed to protrude through or in succession to a spout hole formed in the container; and an annular flange wall extending out radially outwardly from the outer periphery of a lower end part of the protruding tubular wall, wherein an upper surface or lower surface of the annular flange wall is welded to an inner surface or outer surface of the container, and an annular score is formed in an inner peripheral edge part of the annular flange wall, characterized in that an annular additional score is formed in the inner peripheral edge part of the annular flange wall in such a manner as to be disposed adjacent to the annular score radially outwardly of and/or radially inwardly of the annular score.

Preferably, a residual wall thickness at the site of the annular additional score is larger than a residual wall thickness at the site of the annular score. The annular additional scores are preferably disposed adjacent to the annular score both radially outwardly of and radially inwardly of the annular score. The annular score and the annular additional score are advantageously formed by disposing annular grooves in a lower surface of the annular flange wall. Particularly when the synthetic resin spout stopper is formed from a low density polyethylene having a density of 0.90 to 0.95 g/cm$^3$, it is preferred that the residual wall thickness at the site of the annular score be 0.10 to 0.30 mm, and the residual wall thickness at the site of the annular additional score be 0.15 to 0.55 mm. Preferably, the center diameter D1 of the annular score is equal to or smaller than the inner diameter D2 of the spout hole of the container (D1≤D2). In preferred embodiments, the protruding tubular wall has a small-diameter lower end portion extending out upwardly from the upper surface of the annular flange wall and having an outer diameter D3, and a large-diameter lower end portion extending out upwardly in succession to the small-diameter lower end portion and having an outer diameter D4, the outer diameter D3 is smaller than the outer diameter D4 (D<D4) and also smaller than the center diameter D1 (D3<D1), the outer diameter D4 is equal to or smaller than the inner diameter D2 (D4≤D2), and the length L from the upper surface of the annular flange wall to the upper end of the small-diameter lower end portion of the protruding tubular wall is smaller than a wall thickness M defining the spout hole of the container (L<M). The outer diameter D4 is preferably equal to or larger than the center diameter D1 (D1≤D4).

Effects of the Invention

As will be clearly understood from Example and Comparative Example to be described later, the synthetic resin spout stopper of the present invention offers the following advantages: When the container is discarded, the annular score is not difficult to break. Even if a considerably great impact is applied to the spout stopper owing to a fall of the container, the annular score formed in the annular flange wall is prevented from being damaged. Even when ultrasonic welding is employed for welding the container and the spout stopper, the annular score formed in the annular flange wall is prevented from being damaged.

MODE FOR CARRYING OUT THE INVENTION

A preferred embodiment of a synthetic resin spout stopper according to the present invention will now be described in further detail with reference to the accompanying drawings.

Figure 1:
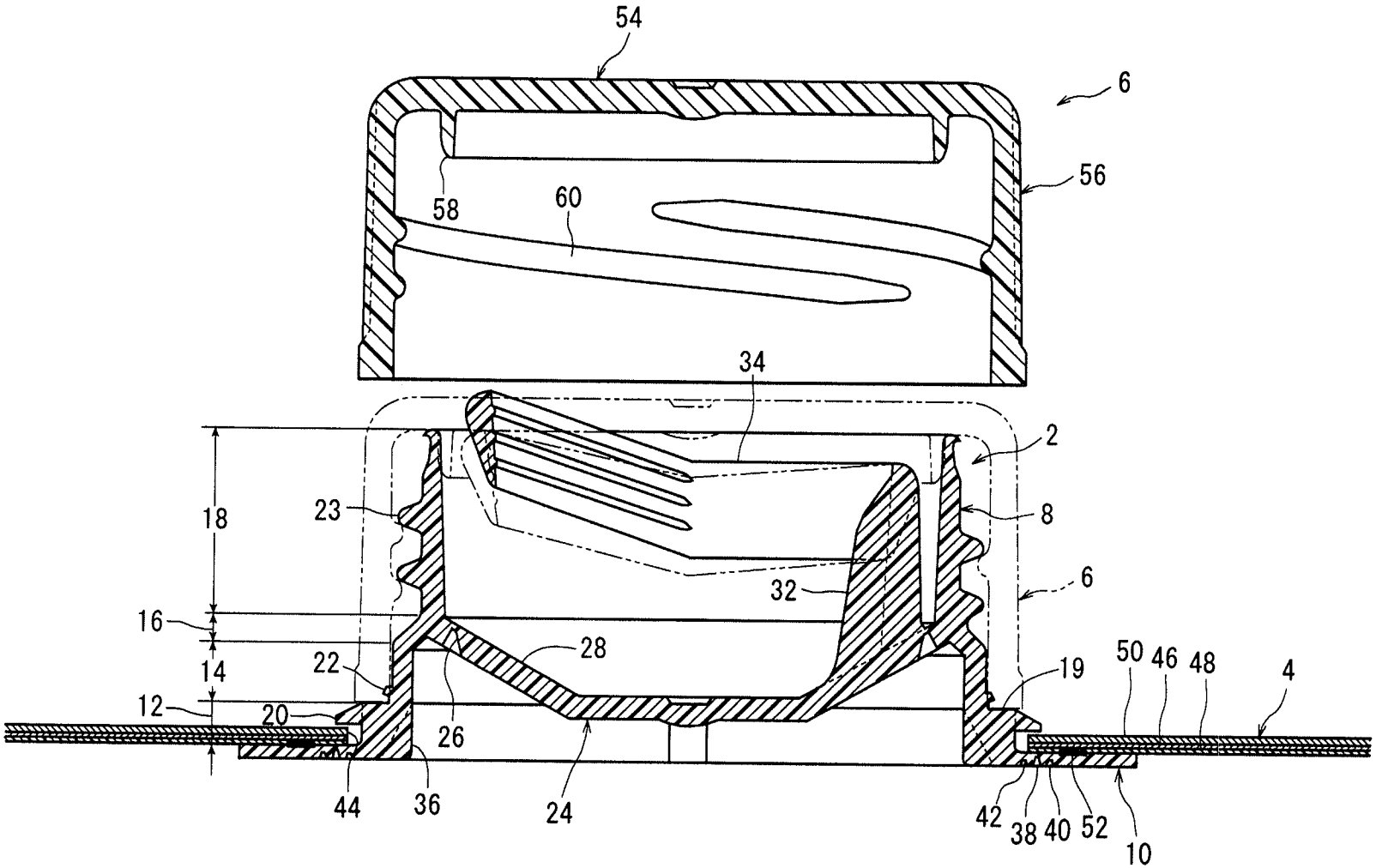
FIG. 1 is a sectional view showing a preferred embodiment of a synthetic resin spout stopper constituted in accordance with the present invention, along with a container and an outer lid.

FIG. 1 shows a synthetic resin spout stopper 2 constituted in accordance with the present invention and, along with this spout stopper 2, a part of a container 4 to which the spout stopper 2 is applied, and an outer lid 6 to be combined with the spout stopper 2.

Figure 2:
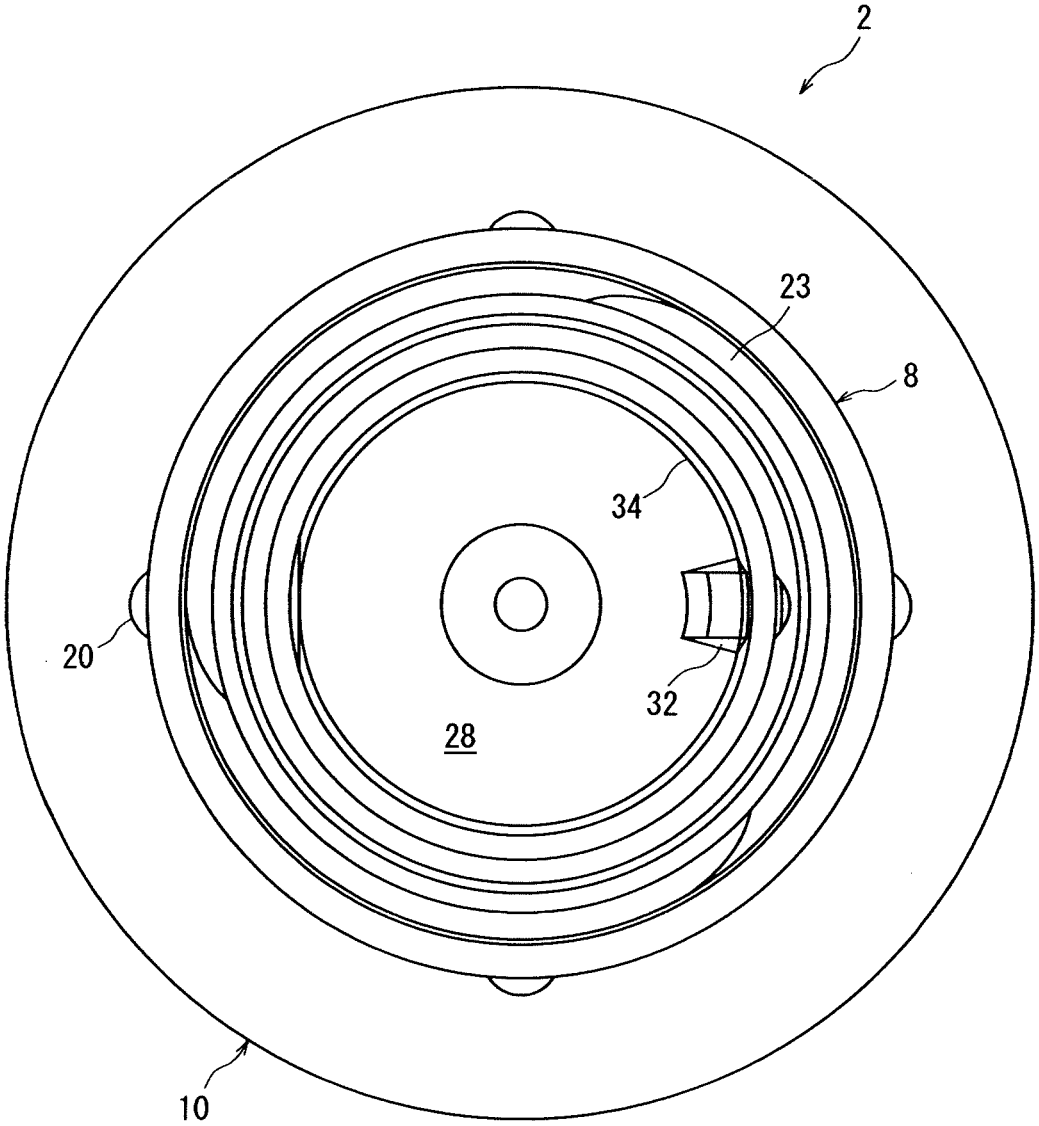
FIG. 2 is a plan view of the spout stopper shown in FIG. 1.
Figure 3:
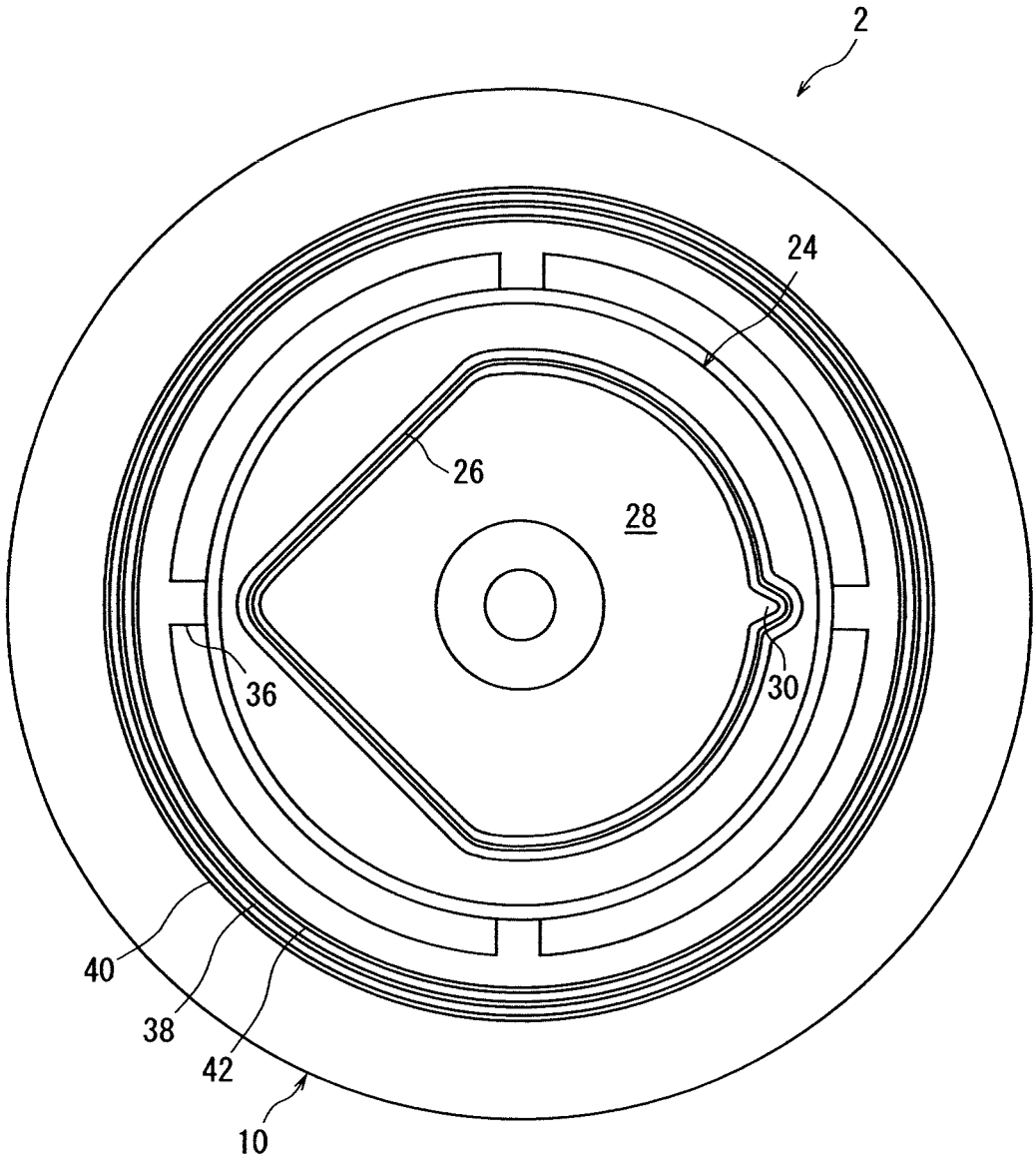
FIG. 3 is a bottom view of the spout stopper shown in FIG. 1.

By reference to FIGS. 2 and 3 together with FIG. 1, the spout stopper 2 which can be injection- or compression-molded from a suitable synthetic resin, for example, low density polyethylene having a density of the order of 0.90 to 0.95 g/cm$^3$, comprises a protruding tubular wall 8 of a nearly cylindrical shape as a whole, and an annular flange wall 10 which extends out radially outwardly from a lower end part, the lowermost end in the illustrated embodiment, of the protruding tubular wall 8 and which is preferably doughnut-shaped. The protruding tubular wall 8 has a relatively thick-walled cylindrical lower end portion 12, an upright cylindrical portion 14 extending from the lower end portion 12 upwardly and substantially vertically, a truncated cone-shaped tubular portion 16 extending in succession to the upright cylindrical portion 14 upwardly in a radially inwardly inclined manner, and a cylindrical spout tubular portion 18 further extending from the truncated cone-shaped tubular portion 16 upwardly and substantially vertically. An upwardly pointed annular shoulder surface 19 is defined at the boundary between the lower end portion 12 and the upright cylindrical portion 14. The annular shoulder surface 19 is advantageously extended substantially horizontally. In an outer peripheral surface upper end part of the lower end portion 12, four protruding pieces 20 are arranged at equal intervals in the circumferential direction. An annular sealing ridge 22 is formed in an outer peripheral surface lower part of the upright cylindrical portion 14. An external thread 23 is formed on the outer peripheral surface of the spout tubular portion 18. The upper end surface of the spout tubular portion 18 is formed in a nearly semicircular shape in a sectional view, and its radially outer edge is lip-shaped.

A circular blocking wall 24 is disposed on the inner peripheral surface of the truncated cone-shaped tubular portion 16. The blocking wall 24 has an inverse truncated cone-shaped outer peripheral edge part, and a circular middle part extending substantially horizontally. An annular breakage score 26 is formed in the blocking wall 24. As will be clearly understood by reference to FIG. 3, the annular breakage score 26 defines a tear-off area 28 of a shape having a combination of a nearly isosceles triangular part (a left half part in FIG. 3) and a nearly semicircular part (a right half part in FIG. 3). A relatively small protruding region 30 is present at the right end, in FIG. 3, of the tear-off area 28. A connecting post 32 extending upward is formed on a right end part upper surface, in FIG. 2, of the tear-off area 28, and a ring 34 is coupled to the upper end of the connecting post 32. As will be understood by reference to FIG. 1 and FIG. 3, the inner peripheral surface of the lower end portion 12 of the protruding tubular wall 8 is in the shape of a truncated cone inclined radially outwardly in a downward direction. On the inner peripheral surface of the lower end portion 12 shaped like the truncated cone, four bulging-out portions 36 are formed at 90-degree angular intervals. The inner peripheral surface of the bulging-out portion 36 extends substantially vertically. The angular positions at which the four bulging-out portions 36 are arranged are allowed to correspond to specifically shaped parts of the tear-off area defined by the annular breakage score 26, namely, the apex of the isosceles triangle, the two boundary sites of the nearly isosceles triangular part and the nearly semicircular part, and the protruding region 30. These bulging-out portions 36 make up for the locally low strength of the annular breakage score 26 in the specific area.

Figure 4:
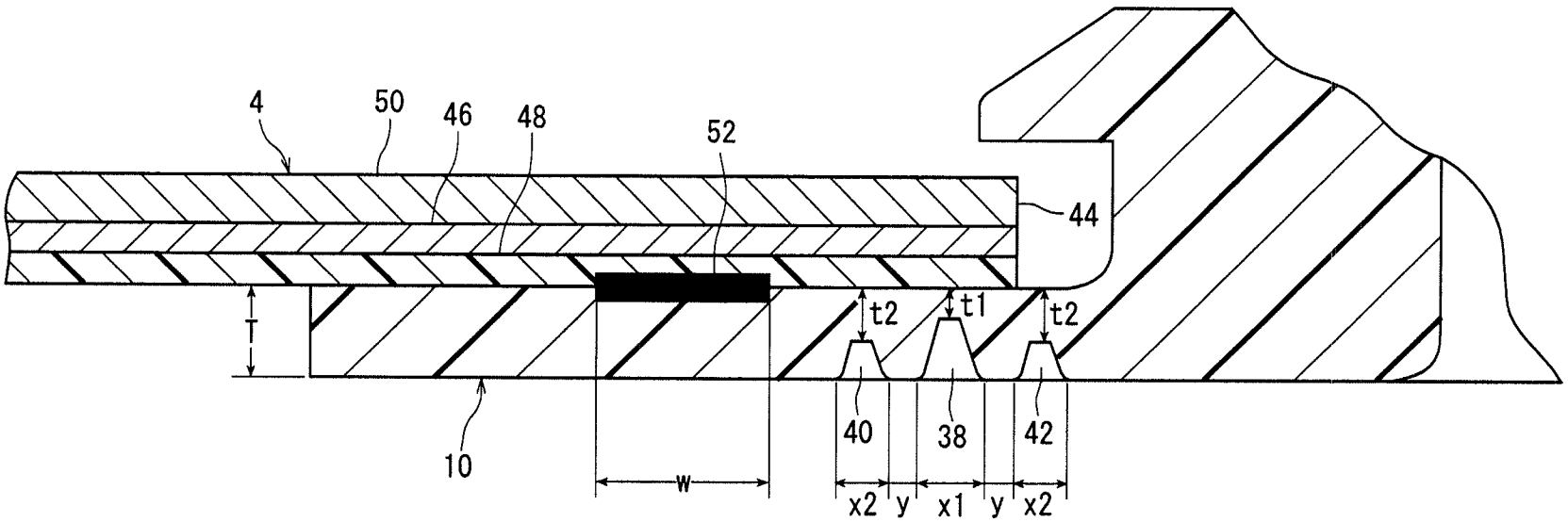
FIG. 4 is an enlarged fragmentary sectional view of the spout stopper shown in FIG. 1.

By reference to FIG. 4 along with FIG. 1 and FIG. 3, an annular score 38 is formed in an inner peripheral edge part of the annular flange wall 10 of the spout stopper 2. The annular score 38 preferably in the shape of a doughnut is formed, in the illustrated embodiment, by disposing an annular groove in the lower surface of the annular flange wall 10. In the spout stopper 2 constituted in accordance with the present invention, it is important that an annular additional score disposed adjacent to the annular score 38 on at least one of a side radially outward of the annular score 38 and a side radially inward of the annular score 38 be formed in the inner peripheral edge part of the annular flange wall 10. In the illustrated embodiment, there are formed an annular additional score 40 placed adjacent to the annular score 38 on the side radially outward of the annular score 38, and an annular additional score 42 placed adjacent to the annular score 38 on the side radially inward of the annular score 38. The annular additional scores 40 and 42, which are preferably doughnut-shaped, are both formed, as is the annular score 38, by forming annular grooves in the lower surface of the annular flange wall 10. The residual wall thickness t2 at the site of each of the annular additional scores 40 and 42 is advantageously larger than the residual wall thickness t1 at the site of the annular score 38. When the spout stopper 2 is formed from a low density polyethylene having a density of the order of 0.90 to 0.95 g/cm$^3$, for example, it is preferred that the residual wall thickness t1 at the site of the annular score 38 be of the order of 0.10 to 0.30 mm, while the residual wall thickness t2 at the sites of the annular additional scores 40 and 42 be of the order of 0.15 to 0.55 mm.

Further with reference to FIG. 1 and FIG. 4, the spout stopper 2 can be applied to a spout hole 44 of the container 4 which, per se, may be of a well known form. The container 4 illustrated only partly in FIGS. 1 and 4 can be formed from a boxboard 50 having an aluminum foil 46 and a synthetic resin film 48 laminated to the inner surface thereof. When the spout stopper 2 is formed from polyethylene, it is preferred that the synthetic resin film 48 be a polyethylene film, from the viewpoint of the ease of welding. In the illustrated embodiment, as clearly shown in FIG. 1 and FIG. 4, the annular flange wall 10 of the spout stopper 2 has an upper surface in contact with the inner surface of the container 4, and the protruding tubular wall 8 of the spout stopper 2 is protruded upward through the spout hole 44 of the container 4. The upper surface, radially outward of the annular breakage score 26 and the annular additional scores 40 and 42, of the annular flange wall 10 of the spout stopper 2 is welded to the inner surface of the container 2. In FIG. 4, an annular weld area where the upper surface of the annular flange wall 10 is welded to the inner surface of the container 4 is indicated by a thick line 52. Such welding can advantageously be performed by an ultrasonic welding method, which is well known per se, prior to completing a box using a boxboard. At this time, the protruding tubular wall 8 of the spout stopper 2 is inserted through the spout hole 44 of the container 4, and the opening edge of the container 4 defining the spout hole 44 is positioned between the annular flange wall 10 and the protruding pieces 20 of the spout stopper 2 to hold the spout stopper 2 in the container 4 temporarily, whereafter welding is carried out. As is well known among people skilled in the art, when ultrasonic waves are applied to the weld area 52, an ultrasonic impact is caused to the weld area 52. In the spout stopper 2 constituted in accordance with the present invention, however, the ultrasonic impact on the weld area 52 is cushioned by the annular additional score 40, the annular score 38, and the annular additional score 42, with the result that damage to the annular score 38 or the annular breakage score 26 is avoided.

By reference to FIG. 1, the outer lid 6, which can be injection- or compression-molded from a suitable synthetic resin such as high density polyethylene or polypropylene, includes a circular top wall 54, and a cylindrical skirt wall 56 suspending from the outer peripheral edge of the top wall 54. An annular sealing piece 58 is formed on the inner surface of the top wall 54. An internal thread 60 is formed on the inner peripheral surface of the skirt wall 56. In the outer peripheral surface of the skirt wall 56, irregularities (so-called knurls) are formed for preventing the slippage of fingers engaged therewith. As indicated by dashed double-dotted lines in FIG. 1, the outer lid 6 is fitted over the protruding tubular wall 8 of the spout stopper 2, and rotated clockwise as viewed from above in FIG. 1 to screw the internal thread 60 to the external thread 23, whereby the outer lid 6 is mounted on the protruding tubular wall 8. When the outer lid 6 is mounted on the protruding tubular wall 8 of the spout stopper 2 as required, the sealing piece 58 of the outer lid 6 is brought into intimate contact with the inner peripheral surface upper end part of the protruding tubular wall 8 of the spout stopper 2, and the lower end of the skirt wall 56 of the outer lid 6 is allowed to abut on the annular shoulder surface 19 defined by the protruding tubular wall 8 of the spout stopper 2. Moreover, the inner surface of the top wall 54 of the outer lid 6 makes contact with an upper end part of the ring 34 (its left end part in FIG. 1) to displace the ring 34 elastically somewhat downwardly. The annular sealing ridge 22 formed in the outer peripheral surface lower part of the upright cylindrical portion 14 in the protruding tubular wall 8 of the spout stopper 2 is brought into close contact with the inner peripheral surface of the skirt wall 56 of the outer lid 6. A material to become contents is charged into the container 4, and the outer lid 6 is mounted on the protruding tubular wall 8 of the spout stopper 2. When this container 4 is put into distribution, it is not rare that the container 4 is fallen through carelessness and, because of this, the spout stopper 2 undergoes a considerable impact. In the spout stopper 2 configured in accordance with the present invention, however, the annular additional score 40 and/or the annular additional score 42 are or is formed in addition to the annular score 38. Thus, even if a considerable impact is given to the spout stopper 2 owing to the fall, the annular score 38 or the breakage score 26 is not damaged, as will be clearly understood from the Example and the Comparative Example to be described later.

When the contents of the container 4 are to be consumed, the outer lid 6 is rotated counterclockwise as viewed from above in FIG. 1 to release the internal thread 60 from the external thread 23, thereby removing the outer lid 6 from the protruding tubular wall 8 of the spout stopper 2. Then, a finger is hooked through the ring 34 of the spout stopper 2, and the ring 34 is pulled by the finger. As a result, the annular breakage score 26 is broken, and the tear-off area 28 is torn off, whereby a discharge opening is formed in the blocking wall 24. Thus, the contents of the container 4 can be discharged through the spout hole 44 of the container 4 and the discharge opening formed in the blocking wall 24.

After all of the contents inside the container 4 are consumed, it is important that most of the spout stopper 2, i.e., the protruding tubular wall 8 and an area in the annular flange wall 10 radially inward of the annular score 38, be separated from the container 4 for the purpose of the so-called sorted trash collection for recovery. At this time, a pressing force is exerted on a required site of the container 4, or the method described in the specification and drawings of Japanese Patent Application No. 2009-228175 filed by the applicant of the present application is carried out. By this procedure, the annular score 38 is broken to separate most of the spout stopper 2 from the container 4. By so doing, the amount of the synthetic resin (polyethylene) accompanying the container 4 is rendered a sufficiently low value permissible for the so-called sorted trash collection for recovery.

In the above-described embodiment, the upper surface of the annular flange wall 10 of the spout stopper 2 is welded to the inner surface of the container 4. If desired, however, the lower surface of the annular flange wall 10 can be welded to the outer surface of the container 4 such that the protruding tubular wall 8 protrudes upwardly in succession to the spout hole 44 of the container 4. In this case, it is desirable to laminate a synthetic resin film to the outer surface of the container 4, thereby facilitating the welding between the annular flange wall 10 of the spout stopper 2 and the outer surface of the container 4.

Figure 5:
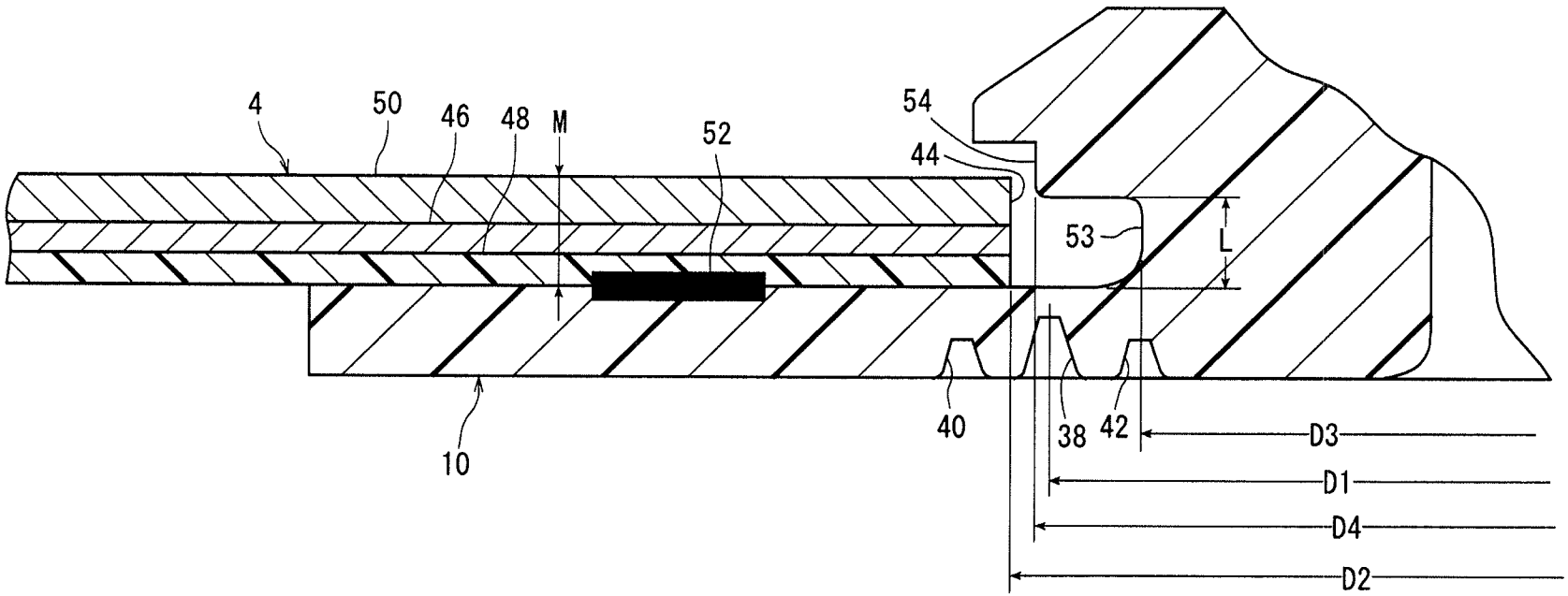
FIG. 5 is an enlarged fragmentary sectional view showing another preferred embodiment of a synthetic resin spout stopper constituted in accordance with the present invention.

FIG. 5 shows another embodiment of a synthetic resin spout stopper constituted in accordance with the present invention. In the embodiment shown in FIG. 5, the center diameter D1 of the annular score 38 is rendered equal to or smaller than the inner diameter D2 of the spout hole 44 (D1≤D2). The lower end portion 12 of the protruding tubular wall 8 includes a small-diameter lower end portion 53 extending out upwardly from the upper surface of the annular flange wall 10, and a large-diameter lower end portion 54 extending out upwardly in succession to the small-diameter lower end portion 53. The outer diameter D3 of the small-diameter lower end portion 53 is smaller than the outer diameter D4 of the large-diameter lower end portion 54 (D3<D4). The outer diameter D3 of the small-diameter lower end portion 53 is smaller than the center diameter D1 of the annular score 38 (D3<D1). The outer diameter D4 of the large-diameter lower end portion 54 is set to be equal to or smaller than the inner diameter D2 of the spout hole 44 (D4≤D2). Further, the outer diameter D4 of the large-diameter lower end portion 54 is preferably set at a value equal to or larger than the center diameter D1 of the annular score 38 (D1≤D4). The length L from the upper surface of the annular flange wall 10 to the upper end of the small-diameter lower end portion 53 of the protruding tubular wall 8 is set to be smaller than a wall thickness M defining the spout hole 44 of the container 4 (L<M).

For so-called sorted trash collection for recovery, the annular score 38 is broken when separating from the container 4 most of the spout stopper 2, i.e., the protruding tubular wall 8 and the area in the annular flange wall 10 radially inward of the annular score 38. By so doing, most of the spout stopper 2 is separated from the container 4. Then, most of the spout stopper 2 is moved upward and released from the container 4. In the embodiment shown in FIG. 5, the center diameter D1 of the annular score 38 is equal to or smaller than the inner diameter D2 of the spout hole 44 of the container 4 (D1≤D2). Thus, when the spout stopper 2 is moved upward, the wall part defining the spout hole 44 of the container 4 does not interfere with the movement of the spout stopper 2. Consequently, most of the spout stopper 2 can be released from the container 4, without need for excessive force.

In connection with the embodiment shown in FIG. 5, the following facts should further be noted: The outer diameter D3 of the small-diameter lower end portion 53 of the protruding tubular wall 8 is smaller than the center diameter D1 of the annular score 38 (D3<D1); the outer diameter D4 of the large-diameter lower end portion 54 of the protruding tubular wall 8 is equal to or larger than the center diameter D1 of the annular score 38, and is also equal to or smaller than the inner diameter D2 of the spout hole 44 (D1≤D4≤D2); and the length L from the upper surface of the annular flange wall 10 to the upper end of the small-diameter lower end portion 53 of the protruding tubular wall 8 is set to be smaller than the wall thickness M defining the spout hole 44 of the container 4 (L<M). Assume, here, that a slight error is produced in centering the spout hole 44 of the container 4 and the spout stopper 2 with respect to each other when the protruding tubular wall 8 of the spout stopper 2 is protruded upward through the spout hole 44 of the container 4 and the upper surface of the annular flange wall 10 of the spout stopper 2 is welded to the inner surface of the container 4. Even in this case, the inner peripheral edge of the spout hole 44 makes contact with the outer peripheral surface of the large-diameter lower end portion 54 of the protruding tubular wall 8. Thus, the inner peripheral edge of the spout hole 44 is not located radially inwardly of the center diameter position of the annular score 38. As a result, when the spout stopper 2 is moved upward, the movement of the spout stopper 2 is reliably prevented from interference by the wall part defining the spout hole 44 of the container 4.

Experimental Example

The spout stopper 2 of the form illustrated in FIGS. 1 to 4 was molded from polyethylene having a density of 0.92 g/cm$^3$. The thickness T of the annular flange wall 10 was 0.60 mm, the residual wall thickness t1 at the site of the annular score 38 was 0.20 mm, and the residual wall thickness t2 at the site of each of the annular additional scores 40 and 42 was 0.35 mm. The opening width x1 of the annular score 38 was 0.35 mm, the opening width x2 of each of the annular additional scores 40 and 42 was 0.30 mm, and the distance y between the annular score 38 and each of the annular additional scores 40 and 42 was 0.20 mm. As shown in FIG. 4, the protruding tubular wall 8 of the spout stopper 2 was protruded through the spout hole 44 of the container 4, the upper surface of the annular flange wall 10 of the spout stopper 2 was brought into intimate contact with the inner surface of the container 4, and the upper surface of the annular flange wall 10 was ultrasonically welded to the inner surface of the container 4. The width W of the annular weld area 52 was 1.0 mm. The container 4 was a container called a gable top type formed from a material having the aluminum 46 and the polyethylene film 48 laminated to the inner surface of the boxboard 50 (a container having an upper surface processed into a gable-roofed shape). The spout hole 44 was of a shape formed in the one-side inclined surface of the upper surface of the container 4, and its nominal holding capacity was 1,000 cm$^3$. Tap water (1,000 cm$^3$) was poured into the container 4 through the gable top of the container 4, and then the gable top of the container 4 was sealed. As indicated by the dashed double-dotted lines in FIG. 1, the outer lid 6 molded from polyethylene having a density of 0.92 g/cm$^3$ was mounted on the container 4. In this manner, an Experimental Example product was prepared.

(1) Before tap water was poured into the container 4, it was visually confirmed whether the annular score 38 of the spout stopper 2 welded to the container 4 became clouded (cloudiness of the score 38 means that the score 38 was damaged at least partially). Then, (2) in connection with 200 of the above-mentioned Experimental Example products, it was visually tested whether or not leakage of tap water occurred for a reason such that a pinhole was formed in the annular score 38 at the time of welding of the spout stopper 2. More specifically, the container 4 was inverted, and whether or not tap water was leaking near the spout stopper 2 was tested, with the body of the container 4 being pressed with fingers. (3) Moreover, 10 of the aforementioned Experimental Example products were dropped repeatedly, 3 times, in an erect state from a height of 30 cm onto a horizontal floor surface; dropped repeatedly, 3 times, in a sideways-toppled state from a height of 30 cm onto the horizontal floor surface; dropped repeatedly, 3 times, in an inverted state from a height of 30 cm onto the horizontal floor surface; and dropped repeatedly, 3 times, onto the horizontal floor surface, with the container 4 being inclined at 45 degrees and the spout stopper 2 being directed downwards so that the spout stopper 2 would collide with the horizontal floor surface. Under these conditions, it was tested whether or not leakage of tap water occurred near the spout stopper 2. (4) Furthermore, the container 4 was maintained in a state inclined at 45 degrees, with the spout stopper 2 being directed downwards, and a hoisting stand was lowered in a state in which a pressing jig fixed to a push-pull gauge mounted on the hoisting stand was in contact with the spout stopper 2. A force required when the annular score 38 was broken under these conditions was measured. The results are shown in Table 1 below.

Comparative Experimental Example

For the purpose of comparison, the same spout stopper as in the Experimental Example product was prepared, except that the residual wall thickness at the site of the annular score formed in the annular flange wall of the spout stopper was 0.30 mm, and that no annular additional score was formed in the annular flange wall. In the same manner as in the Experimental Example, measurements were made for the following tests: (1) presence or absence of cloudiness of the annular score, (2) whether leakage due to a pinhole or the like occurred or not, (3) whether leakage occurred or not after dropping, and (4) the force necessary for breakage of the annular score. The results are as shown in Table 1.

TABLE 1

| | Experimental Example | Comparative Experimental Example |
|---|---|---|
| Cloudiness of annular score | Absent | Present |
| Leakage due to pinhole, etc. | 0 of 200 products | 2 of 200 products |
| Leakage after dropping | 0 of 10 products | 2 of 10 products |
| Force necessary for score breakage | 87.2N | 101.1N |

EXPLANATIONS OF LETTERS OR NUMERALS

2: Spout stopper
4: Container
6: Outer lid
8: Protruding tubular wall
10: Annular flange wall
38: Annular score
40: Annular additional score
42: Annular additional score
44: Spout hole
53: Small-diameter lower end portion of protruding tubular wall
54: Large-diameter lower end portion of protruding tubular wall

The invention claimed is:

1. A synthetic resin spout stopper to be applied to a paper container having at least a synthetic resin film laminated to an inner surface or outer surface thereof, comprising:
- a protruding tubular wall allowed to protrude through or in succession to a spout hole formed in the container;
- an annular flange wall extending radially outwardly from an outer periphery of a lower end part of the protruding tubular wall;
- an upper surface or a lower surface of the annular flange wall being welded to an inner surface or an outer surface of the container;
- an annular score arranged in an inner peripheral edge portion of the annular flange wall; and
- at least one annular additional score arranged in the inner peripheral edge portion of the annular flange wall and being disposed adjacent to and one of:
  radially outwardly of the annular score; or
  radially inwardly of the annular score;
- a residual wall thickness at a location of the at least one annular additional score being larger than a residual wall thickness at a location of the annular score; and
- the synthetic resin spout stopper being removable from the container upon breaking the annular flange wall in an area of the annular score.

2. The synthetic resin spout stopper according to claim 1, wherein the at least one annular additional score comprises first and second additional annular scores disposed adjacent to the annular score and radially outwardly of and radially inwardly of the annular score.

3. The synthetic resin spout stopper according to claim 1, wherein the annular score and the at least one annular additional score comprise annular grooves arranged in a lower surface of the annular flange wall.

4. The synthetic resin spout stopper according to claim 1, wherein a residual wall thickness at a location of the annular score is between 0.10 and 0.30 mm, and a residual wall thickness at a location of the at least one annular additional score is between 0.15 and 0.55 mm.

5. The synthetic resin spout stopper according to claim 1, wherein the synthetic resin spout stopper is foamed from a low density polyethylene having a density of between 0.90 and 0.95 g/cm$^3$.

6. The synthetic resin spout stopper according to claim 1, wherein a center diameter D1 of the annular score is equal to or smaller than an inner diameter D2 of the spout hole of the container such that (D1≤D2).

7. The synthetic resin spout stopper according to claim 6, wherein the protruding tubular wall has a small-diameter lower end portion extending out upwardly from the upper surface of the annular flange wall and having an outer diameter D3, and a large-diameter lower end portion extending out upwardly in succession to the small-diameter lower end portion and having an outer diameter D4, the outer diameter D3 is smaller than the outer diameter D4 such that (D3<D4) and also smaller than the center diameter D1 such that (D3<D1), the outer diameter D4 is equal to or smaller than the inner diameter D2 such that (D4≤D2), and a length L from the upper surface of the annular flange wall to an upper end of the small-diameter lower end portion of the protruding tubular wall is smaller than a wall thickness M of the paper container surrounding the spout hole of the container such that (L<M).

8. The synthetic resin spout stopper according to claim 7, wherein the outer diameter D4 is equal to or larger than the center diameter D1 such that (D1≤D4).

9. The synthetic resin spout stopper according to claim 1, wherein the annular score is a first annular recess, and wherein the at least one annular additional score comprises:
- a second annular recess arranged radially outwardly of the annular recess; and
- a third annular recess arranged radially inwardly of the annular score.

10. The synthetic resin spout stopper according to claim 1, wherein each of:
- the annular score is a first annular recess having a first depth;
- the at least one annular additional score comprises:
  - a second annular recess arranged radially outwardly of the annular recess and having a second depth; and
  - a third annular recess arranged radially inwardly of the annular recess and having a third depth; and
- the second and third depths are less than the first depth.

11. A synthetic resin spout stopper arranged on a container and comprising:
- a tubular portion protruding through a spout hole arranged on the container;
- a flange wall extending radially outwardly from the tubular portion;
- an outer diameter of the flange wall being greater than a diameter of the spout opening;
- the annular flange wall being welded to one of:
  - an inner surface of a wall of the container surrounding the spout hole; and an outer surface of a wall of the container surrounding the spout hole;

a first annular groove arranged in the annular flange wall and having a first depth and first diameter;

a second annular groove arranged in the annular flange wall and having a second depth and a second diameter;

a thickness of the flange wall in an area of the first and second annular grooves being greater than the first and second depths;

the first depth is different than the second depth; and the first diameter is smaller than the diameter of the spout hole, wherein the synthetic resin spout stopper is removable from the container upon breaking the flange wall at the second annular groove.

12. The synthetic resin spout stopper according to claim 11, wherein each of:

the first depth is less than the second depth; and the second diameter is greater than the diameter of the spout hole.

13. The synthetic resin spout stopper according to claim 11, further comprising:

a third annular groove arranged in the annular flange wall and having a third depth and a third diameter, wherein the third depth is the less than the second depth and the third diameter is greater than the second diameter.

14. The synthetic resin spout stopper according to claim 13, wherein the third diameter is greater than the diameter of the spout hole.

15. A synthetic resin spout stopper structured and arranged for use on a container, the spout stopper comprising:

a tubular portion adapted to protrude through a spout hole arranged on a container;

a flange wall extending radially outwardly from a lower end of the tubular portion and having an outer diameter;

the flange wall having an annular area structured and arranged to be weldable to one of:

an inner surface of a wall of the container surrounding the spout hole; and an outer surface of a wall of the container surrounding the spout hole;

a first annular groove arranged in the annular flange wall and comprising a first depth and first diameter;

a second annular groove arranged in the annular flange wall and comprising a second depth and a second diameter;

the second depth being different than the first depth;

the first diameter is less than the second diameter and the second diameter is less than an inner diameter of the weldable annular area;

at least one of:

the first depth is less than the second depth; and at least the first diameter is smaller than the diameter of the spout hole; and the synthetic resin spout stopper being removable from the container upon breaking the annular flange wall in an area of the second annular groove.

16. The synthetic resin spout stopper according to claim 15, further comprising:

a third annular groove arranged in the annular flange wall and comprising a third depth and a third diameter;

the second diameter is less than the third diameter and the third diameter is less than the inner diameter of the weldable annular area.

17. The synthetic resin spout stopper according to claim 15, wherein at least two of:

the synthetic resin spout stopper is removable from a container upon breaking the flange wall in an area of the second annular groove;

the weldable annular area is arranged on an upper side of the flange wall;

at least the first and second annular grooves are arranged on a lower side of the flange wall; and the first depth is less than the second depth and the third depth is less than the second depth.

18. The synthetic resin spout stopper according to claim 15, wherein the second diameter is greater than the diameter of the spout hole.

* * * * *

UNITED STATES PATENT AND TRADEMARK OFFICE

CERTIFICATE OF CORRECTION

PATENT NO. : 8,899,442 B2
APPLICATION NO. : 13/511150
DATED : December 2, 2014
INVENTOR(S) : K. Muramato et al.

It is certified that error appears in the above-identified patent and that said Letters Patent is hereby corrected as shown below:

In the Claims

At column 9, line 54 (claim 1, line 14) of the printed patent, please delete "and" after wall.

Signed and Sealed this
Eleventh Day of August, 2015

Michelle K. Lee

Michelle K. Lee
*Director of the United States Patent and Trademark Office*